US005129358A

United States Patent [19]

Myochin et al.

[11] Patent Number: 5,129,358

[45] Date of Patent: Jul. 14, 1992

[54] MAGNETIC ROLLER FOR USE IN A DEVELOPING DEVICE

[75] Inventors: Hisashi Myochin; Yoshinori Inoue; Shinya Sakanashi; Satoshi Hamada; Masao Shimizu, all of Osaka, Japan

[73] Assignee: Minolta Camera Kabushiki Kaisha, Osaka, Japan

[21] Appl. No.: 746,088

[22] Filed: Aug. 12, 1991

Related U.S. Application Data

[63] Continuation of Ser. No. 510,873, Apr. 18, 1990, abandoned.

[30] Foreign Application Priority Data

Apr. 20, 1989 [JP] Japan ..... 1-102144

[51] Int. Cl.[5] ..... G03G 15/09

[52] U.S. Cl. ..... 118/658; 355/251

[58] Field of Search ..... 118/657, 658; 355/251, 355/252, 253, 245; 335/296, 297

[56] References Cited

U.S. PATENT DOCUMENTS

| | | | |
|---|---|---|---|
| 3,863,603 | 2/1975 | Buckley et al. | 355/251 X |
| 4,406,535 | 9/1983 | Sakamoto et al. | 355/251 |
| 4,511,239 | 4/1985 | Kanbe et al. | 118/657 X |
| 4,607,933 | 8/1986 | Haneda et al. | 118/657 X |
| 4,825,241 | 4/1989 | Saijo et al. | 355/253 |
| 4,881,103 | 11/1989 | Seto et al. | 355/251 |
| 4,911,100 | 3/1990 | Yamashita | 355/251 |
| 4,936,249 | 6/1990 | Tajima et al. | 118/658 |
| 4,967,691 | 11/1990 | Chikama et al. | 355/245 X |

FOREIGN PATENT DOCUMENTS 53-94940 8/1978 Japan .

*Primary Examiner*—A. T. Grimley
*Assistant Examiner*—Christopher Horgan
*Attorney, Agent, or Firm*—Burns, Doane, Swecker & Mathis

[57] ABSTRACT

A magnetic roller is fixedly mounted in a developing device provided in an image forming apparatus. The magnetic roller includes a magnetic member, which is made of a mixture of ferromagnetic material and polymeric compound. A plurality of magnetic poles are formed along the periphery of the magnetic member and consist of a main magnetic pole confronting an electrostatic latent image support member of the image forming apparatus, at least two magnetic poles formed adjacent to each other on one side of the main magnetic pole and having a polarity opposite to the polarity of the main magnetic pole, and at least two magnetic poles formed adjacent to each other on the other side of the main magnetic pole and having a polarity opposite to the polarity of the main magnetic pole.

7 Claims, 3 Drawing Sheets

MAGNETIC ROLLER FOR USE IN A DEVELOPING DEVICE

This application is a continuation of application Ser. No. 07/510,873, filed Apr. 18, 1990 now abandoned.

BACKGROUND OF THE INVENTION

1. Field of the Invention

The present invention generally relates to a magnetic roller for use in a developing device provided in an image forming apparatus employing two-component developer, and more particularly, to a magnetic roller fixedly mounted in a developing sleeve confronting an electrostatic latent image support member.

2. Description of the Related Art

FIG. 1 depicts a conventional magnetic roller 20 fixedly mounted in a developing device provided in an image forming apparatus.

The magnetic roller 20 has an outer diameter of, for example, 24.5 mm and comprises a core 21 and a magnetic member 22 formed on the peripheral portion of the core 21 except opposite ends thereof. The magnetic member 22 includes a mixture of ferromagnetic powder, for example ferrite powder, and polymeric compound (resinous material). Magnetic poles N3, S1, N1, S2, and N2 are formed in this order along the periphery of the magnetic member 22. As shown in FIG. 2, these magnetic poles are formed in a manner in which magnetic poles of external magnets 24*a*–24*e* are opposed to the periphery of the roller 20 which has not been magnetized yet.

In the image forming apparatus, developer is held on a developing sleeve while magnetic carrier contained in the developer is prevented from adhering to an electrostatic latent image support member. For this purpose, a magnetic pole confronting the electrostatic latent image support member requires a magnetic force of approximately 1000 gauss.

Furthermore, there is an increasing demand for a small-sized magnetic roller in order to comply with the recent request for a small-sized light apparatus or a multicolor apparatus.

However, in the above-described arrangement in which magnetic poles S and N are alternately formed along the periphery of the magnetic roller 20, if the magnetic roller 20 is reduced to 15 mm in outer diameter, the main magnetic pole N1, which confronts the electrostatic latent image support member and exerts remarkable influence upon the development, cannot be magnetized over 500 gauss. The reason for this is that the magnetic flux density for magnetizing the main magnetic pole N1 is low during a magnetizing process for the magnetic roller 20.

Accordingly, when two-component developer consisting of toner and carrier is used along with a small-sized magnetic roller, the amount of carrier which will be shifted to the electrostatic latent image support member is increased. This is disadvantageous in that the image quality would be lowered and the surface of a fixing roller is liable to be deteriorated.

SUMMARY OF THE INVENTION

Accordingly, the present invention has been developed to substantially eliminate the above-described disadvantage inherent in the prior art magnetic roller for use in a developing device provided in an image forming apparatus, and has as its essential object to provide a small-sized magnetic roller to which a strong magnetic force required for the development can be given.

Another important object of the present invention is to provide a magnetic roller of the above-described type in which a plurality of magnetic poles are arranged so that magnetic fluxes may be converged on a main magnetic pole for the development.

A further object of the present invention is to provide a developing device which accommodates a magnetic roller of the above-described type and can contribute to a small-sized light image forming apparatus.

In accomplishing these and other objects, a magnetic roller according to the present invention comprises a magnetic member forming at least an outermost layer of the magnetic roller, and a plurality of magnetic poles formed along the periphery of the magnetic member. The magnetic poles includes a main magnetic pole confronting an electrostatic latent image support member of an image forming apparatus, at least two magnetic poles formed adjacent to each other on one side of the main magnetic pole and having a polarity opposite to a polarity of the main magnetic pole, and at least two magnetic poles formed adjacent to each other on the other side of the main magnetic pole and having a polarity opposite to the polarity of the main magnetic pole.

The magnetic force of the main magnetic pole is stronger than that of any other magnetic pole having the polarity opposite to the polarity of the main magnetic pole.

The magnetic member comprises a mixture of ferromagnetic material and polymeric compound.

In the magnetic roller having the above-described construction, only the main magnetic pole confronting the electrostatic latent image support member is magnetized in the polarity opposite to the polarity of any other magnetic poles formed on both sides thereof.

Accordingly, magnetic fluxes from a plurality of magnetic poles having the same polarity are converged on the main magnetic pole having the opposite polarity. As a result, not only the magnetic flux density is raised but the magnetic force is strengthened.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
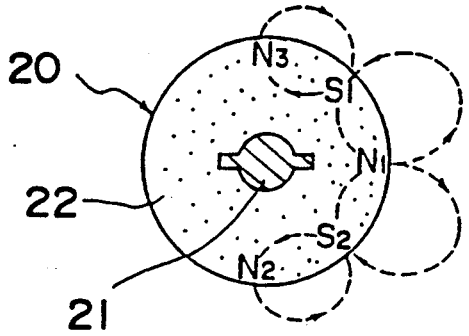
Fig. 1 PRIOR ART
FIG. 1 is a sectional view of a conventional magnetic roller.
Figure 2:
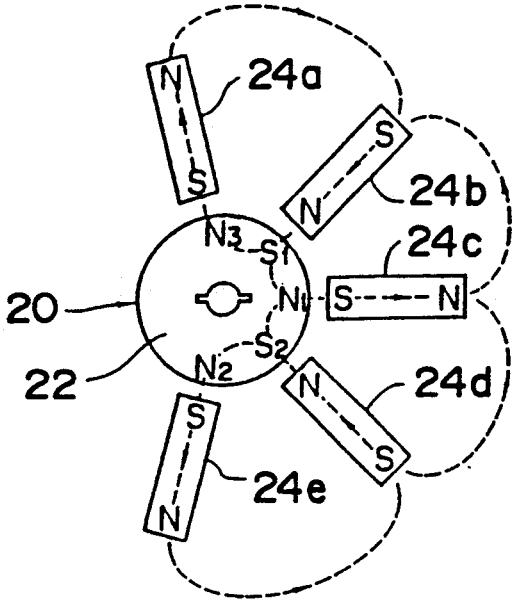
Fig. 2 PRIOR ART
FIG. 2 is a front view of the magnetic roller of FIG. 1 when the magnetic roller is being magnetized.
Figure 3:
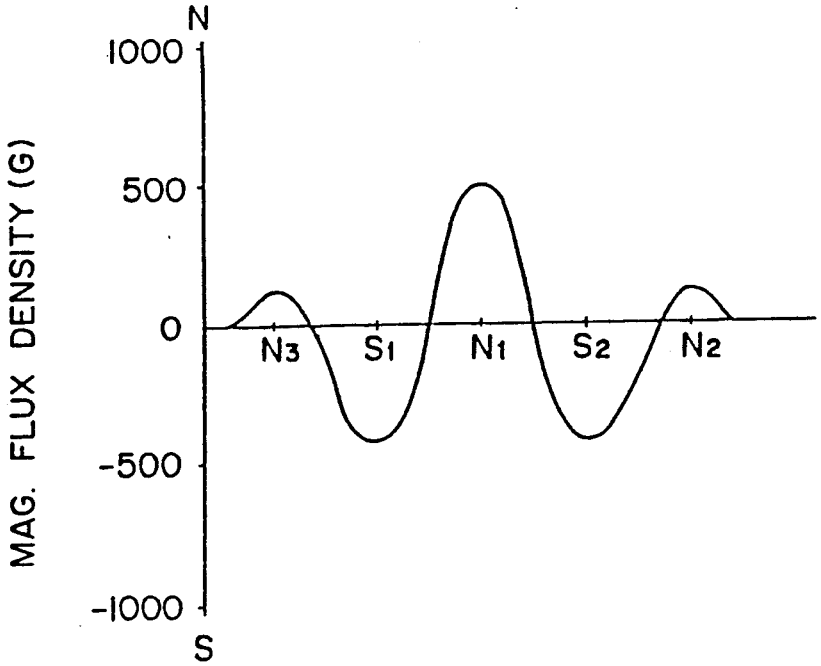
Fig. 3 PRIOR ART
FIG. 3 is a graph indicative of the distribution of magnetic force in the magnetic roller of FIG. 1.
Figure 4:
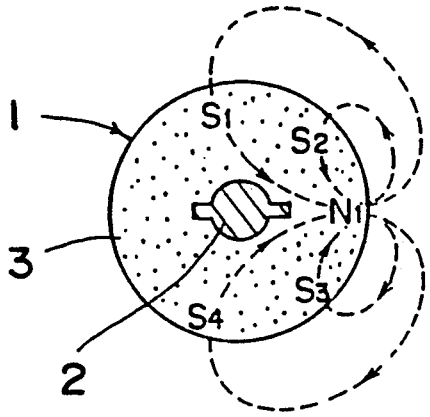
FIG. 4 is a sectional view of a magnetic roller according to the present invention.

Referring now to the drawings, there is shown in FIG. 4 a magnetic roller 1 according to the present invention. The magnetic roller 1 comprises a core 2 and a magnetic member 3 formed on the periphery of the core 2 except opposite ends thereof, as well as the conventional magnetic roller 20 of FIG. 1. The core 2 is made of stainless, iron or the like. The magnetic member 3 comprises a mixture of magnetic material, for example anisotropic ferrite powder, and bonding agent including polyamide or epoxy resin. The magnetic member 3 is formed on the core 2 through injection molding or extrusion molding.

Figure 5:
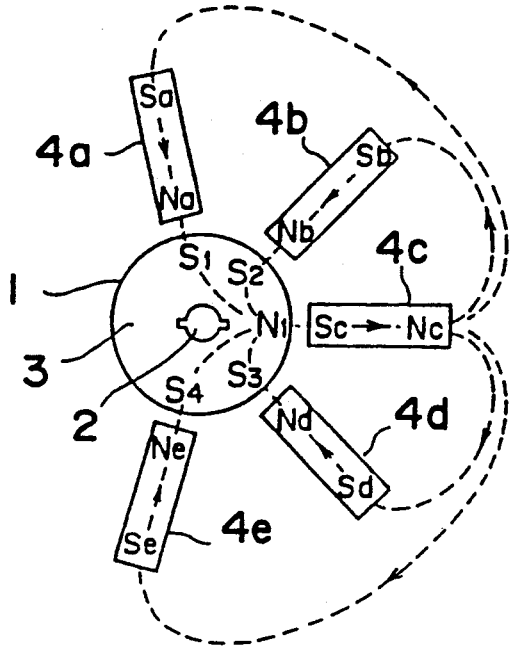
FIG. 5 is a front view of the magnetic roller of FIG. 4 when the magnetic roller is being magnetized.

As shown in FIG. 5, magnetic poles S1, S2, N1, S3, and S4 are formed in this order along the periphery of the magnetic roller 1 in a manner in which magnetic poles Na, Nb, Sc, Nd, and Ne of external magnets 4*a*–4*e* are opposed to the periphery of the magnetic member 3 and spaced therefrom at a predetermined interval.

In the magnetic roller 1 magnetized as described above, the magnetic poles S1 and S2 and the magnetic poles S4 and S5 are formed adjacent to each other and magnetized in the same polarity opposite to the polarity of the magnetic pole N1. Thus, magnetic fields of these magnetic poles S1 and S2, and S4 and S5 repulse each other, and not only magnetic fluxes of the magnetic poles S2 and S3 adjacent to the magnetic pole N1 but also those of the magnetic poles S1 and S4 adjacent to the magnetic poles S2 and S3, respectively, are converged on the magnetic pole N1. As a result, the magnetic flux density on the magnetic pole N1 becomes extremely high.

Figure 6:
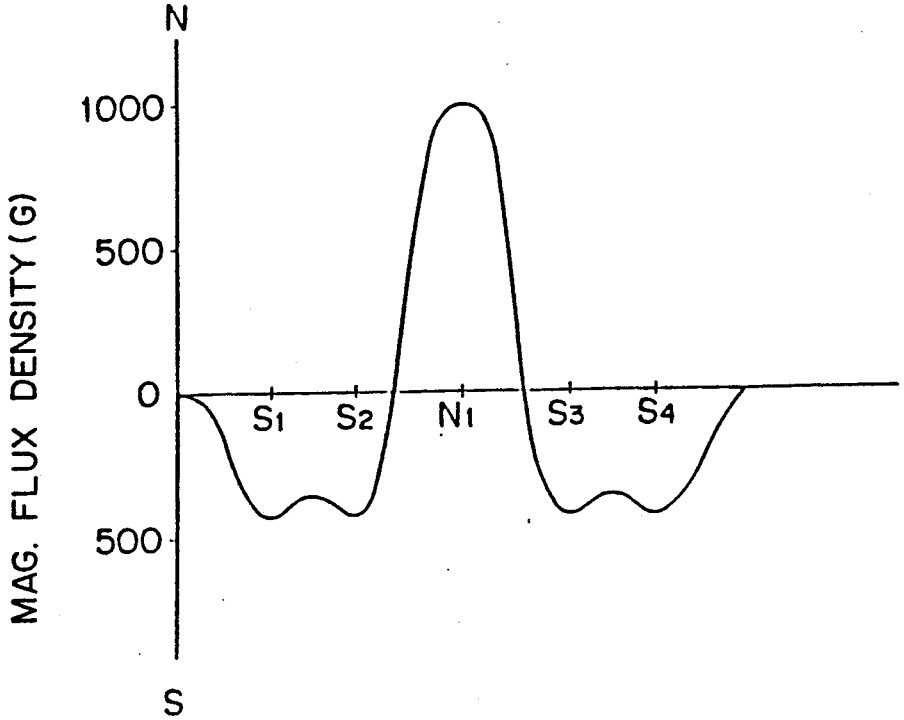
FIG. 6 is a graph indicative of the distribution of magnetic force in the magnetic roller of FIG. 4.

FIG. 6 is a graph indicative of the distribution of magnetic force along the periphery of a magnetic roller having an outer diameter of 10 mm, which is magnetized in a manner as described above. The graph of FIG. 6 clearly indicates that the maximum magnetic flux density on the magnetic pole N1 reaches approximately 1000 gauss.

Accordingly, if the magnetic roller 1 is accommodated in a developing sleeve of a developing device and the magnetic pole N1 is opposed to an electrostatic latent image support member, carrier, which is contained in developer and held on the developing sleeve at a location where the magnetic pole N1 is opposed to the electrostatic latent image support member, is never shifted to the electrostatic latent image support member.

Figure 7:
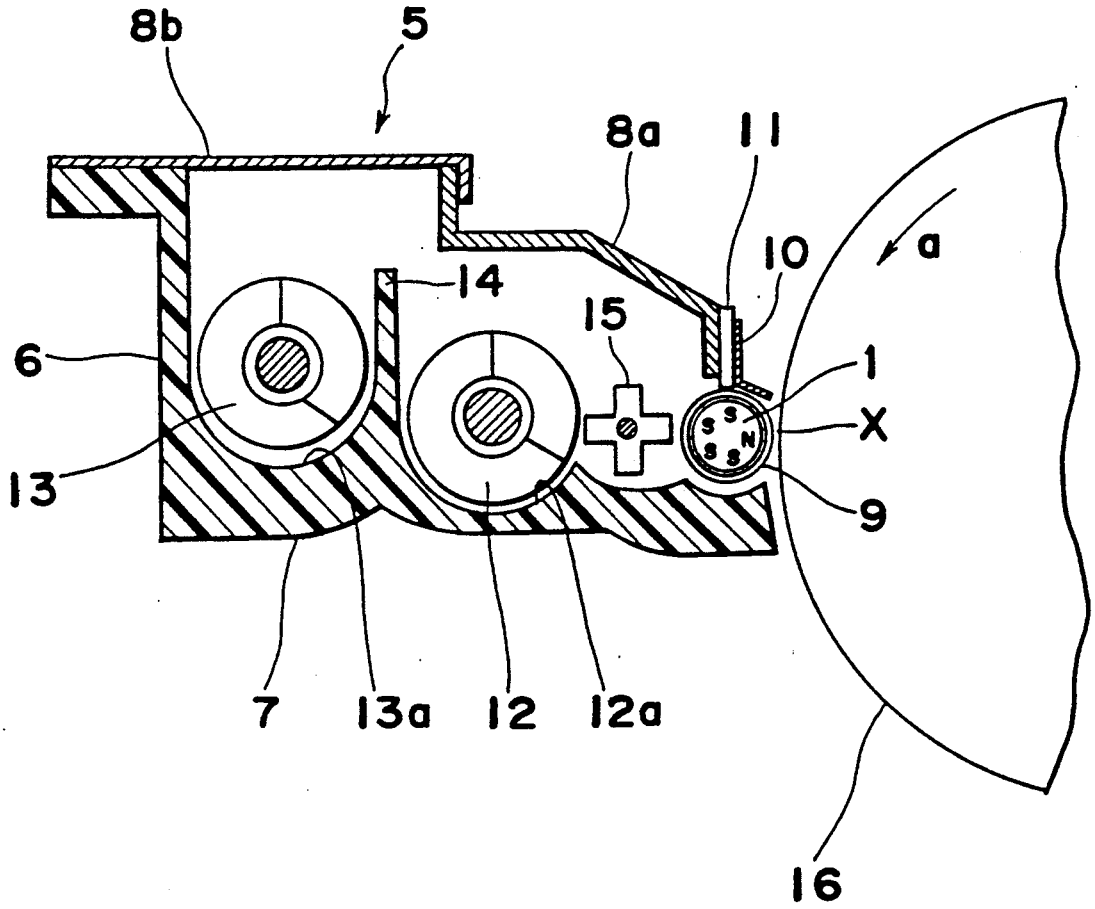
FIG. 7 is a developing device accommodating the magnetic roller of FIG. 4.

FIG. 7 depicts a developing device 5 accommodating the magnetic roller 1 of FIG. 4 according to the present invention. The developing device 5 is disposed in the vicinity of a photosensitive drum 16, which is employed as an electrostatic latent image support member and can rotate at a peripheral speed of 111.76 mm/sec in the direction as shown by an arrow (a) in FIG. 7.

The developing device 5 accommodates in its housing 6 a cylindrical developing sleeve 9, an intermediate roller 15, a first screw roller 12, and a second screw roller 13 in this order from the photosensitive drum 16. The housing 6 comprises a casing 7 constituting a lower structure thereof, a lower cover 8*a*, and an upper cover 8*b*. The surface of the developing sleeve 9 is approximately 0.5 mm spaced from that of the photosensitive drum 16 and is also spaced from the casing 7 at a predetermined interval. The developing device 5 develops an electrostatic latent image formed on the photosensitive drum 16 in a developing region X formed between the developing sleeve 9 and the photosensitive drum 16.

The developing sleeve 9 is made of electrically conductive non-magnetic material and can rotate at a peripheral speed of 235.6 mm/sec. The peripheral surface of the developing sleeve 9 is formed finely uneven through sandblast processing.

A powder scattering prevention plate 10 is disposed above the developing sleeve 9 and spaced from the surface of the developing sleeve 9 at a predetermined interval. Furthermore, a bristle height adjusting member 11 is securely mounted on the lower end of the lower cover 8*a* located above the developing sleeve 9. The lower end of the bristle height adjusting member 11 is approximately 0.55 mm spaced from the surface of the developing sleeve 9.

The intermediate roller 15 interposed between the developing sleeve 9 and the first screw roller 12 has a section in the form of a cross. The intermediate roller 15 supplies the developer transported by the first screw roller 12 to the developing sleeve 9 and stirs the developer so that the developer may be fully electrically charged.

It is to be noted that in the above-described embodiment, although the magnetic roller 1 is constituted by the magnetic member 3 formed on the core 2, this roller may be constituted only by a solid magnetic member, which is provided at its opposite ends with two rotary shafts.

It is further to be noted that the magnetic roller according to the present invention can also be used in an image forming apparatus employing monocomponent developer.

As is clear from the above description, in the magnetic roller according to the present invention, a magnetic pole confronting an electrostatic latent image support member is magnetized in the polarity opposite to the polarity of other magnetic poles formed on both sides of this magnetic pole. Furthermore, at least two magnetic poles having the same polarity are formed adjacent to each other on each side of the magnetic pole confronting the electrostatic latent image support member.

Accordingly, all the magnetic fluxes from a plurality of magnetic poles having the same polarity are converged on the central magnetic pole having the opposite polarity, thereby extremely raising the magnetic flux density at a location where the central magnetic pole is formed.

Therefore, even if the diameter of the magnetic roller is reduced, magnetic force required for the development is satisfactorily produced on the central magnetic pole confronting the electrostatic latent image support member. As a result, magnetic powder contained in the two-component developer is held on the developing sleeve and is never shifted onto the electrostatic latent image support member.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A magnetic roller for use in a developing device provided in an image forming apparatus, said magnetic roller comprising:

a magnetic member forming at least an outermost layer of the magnetic roller;

a plurality of magnetic poles formed along a periphery of said magnetic member, said magnetic poles comprising:

a main magnetic pole adapted to confront an electrostatic latent image support member of the image forming apparatus;

at least two magnetic poles formed adjacent to each other on one side of said main magnetic pole and having a polarity opposite to a polarity of said main magnetic pole; and at least two magnetic poles formed adjacent to each other on the other side of said main magnetic pole and having a polarity opposite to the polarity of said main magnetic pole, wherein said main magnetic pole is a single magnetic pole having a polarity opposite to the polarity of all other magnetic poles formed on both sides of said single magnetic pole.

2. The magnetic roller according to claim 1, wherein a magnetic force of said main magnetic pole is stronger than a magnetic force of any other magnetic pole having the polarity opposite to the polarity of the main magnetic pole.

3. The magnetic roller according to claim 1, wherein said magnetic member comprises a mixture of ferromagnetic material and polymeric compound.

4. A developing device, for use in an image forming apparatus, for developing an electrostatic latent image formed on an electrostatic latent image support member in a developing region, said developing device comprising:

a rotatable developing sleeve for transporting developer to the developing region; a magnetic roller fixedly mounted in said developing sleeve and comprising:

a magnetic member forming at least an outermost layer of the magnetic roller; and a plurality of magnetic poles formed along a periphery of said magnetic member, said magnetic poles comprising a main magnetic pole, at least two magnetic poles formed adjacent to each other on one side of said main magnetic pole and having a polarity opposite to a polarity of said main magnetic pole, and at least two magnetic poles formed adjacent to each other on the other side of said main magnetic pole and having a plurality opposite to the polarity of said main magnetic pole, wherein said main magnetic pole is a single magnetic pole having a polarity opposite to the polarity of all other magnetic poles formed on both sides of said single magnetic pole.

5. The developing device according to claim 4, wherein said main magnetic pole confronts the electrostatic latent image support member in the developing region.

6. The developing device according to claim 5, wherein a magnetic force of said main magnetic pole is stronger than a magnetic force of any other magnetic pole having the polarity opposite to the polarity of the main magnetic pole.

7. The developing device according to claim 4, wherein said magnetic member comprises a mixture of ferromagnetic material and polymeric compound.

* * * * *